US012722845B2

(12) United States Patent
Himmelsbach et al.

(10) Patent No.: US 12,722,845 B2
(45) Date of Patent: Sep. 1, 2026

(54) POURING ELEMENT AND COMPOSITE PACKAGE WITH IMPROVED OPENING BEHAVIOUR

(71) Applicant: SIG Services AG, Neuhausen am Rheinfall (CH)

(72) Inventors: Sven Himmelsbach, Stein am Rhein (CH); David Koller, Fislisbach (CH)

(73) Assignee: SIG Services AG, Neuhausen am Rheinfall (CH)

( * ) Notice: Subject to any disclaimer, the term of this patent is extended or adjusted under 35 U.S.C. 154(b) by 155 days.

(21) Appl. No.: 18/281,031

(22) PCT Filed: Dec. 15, 2021

(86) PCT No.: PCT/EP2021/086007
§ 371 (c)(1),
(2) Date: Sep. 8, 2023

(87) PCT Pub. No.: WO2022/189029
PCT Pub. Date: Sep. 15, 2022

(65) Prior Publication Data

US 2024/0140644 A1 May 2, 2024

(30) Foreign Application Priority Data

Mar. 10, 2021 (EP) ..... 21020137
Jul. 22, 2021 (EP) ..... 21187218

(51) Int. Cl.
*B65D 5/74* (2006.01)
*B65D 5/06* (2006.01)
*B65D 41/04* (2006.01)

(52) U.S. Cl.
CPC ..... *B65D 5/748* (2013.01); *B65D 5/068* (2013.01); *B65D 41/04* (2013.01)

(58) Field of Classification Search
CPC ..... B65D 5/748; B65D 5/068; B65D 41/04; B65D 51/226; B65D 51/228;
(Continued)

(56) References Cited

U.S. PATENT DOCUMENTS 6,223,924 B1 5/2001 Ek et al.
7,458,486 B2 * 12/2008 Weist ..... B65D 5/748 222/83
(Continued)

FOREIGN PATENT DOCUMENTS

CN 107352148 A 11/2017
JP 2003292009 A 10/2003
(Continued)

OTHER PUBLICATIONS

Observations by Third Parties (submitted against EP 21187218.9 published as EP 4056489A1, dated Jan. 18, 2024, attached).
(Continued)

*Primary Examiner* — Vishal Pancholi
(74) *Attorney, Agent, or Firm* — The Webb Law Firm

(57) ABSTRACT

Illustrated and described is a pouring element for a composite package, including a monolithic main body with a flange, a hollow cylindrical spout, which defines a central axis, and a closure part formed in the spout, which runs substantially orthogonal to the central axis, with a weakening zone, a hollow cylindrical cutting element movably guided in the spout with at least one cutting tooth for severing the weakening zone to open the spout and composite package, a reclosable screw cap, which serves to drive the cutting element when the composite package is opened for the first time. Two alternative composite packages for liquid foodstuffs are also described, which are provided
(Continued)

such that a pouring element according to the invention is integrated into the gable region of the composite package. An overall more favourable alternative of a pouring element without additional barrier foil is designed such that the main body consists of at least 92% by weight of HDPE and according to ASTM D3985 has an oxygen transmission rate between 12 and 23 ml $O_2/(m^2*day)$, measured through a measuring surface which is orthogonal to the central axis and runs through the flange of the main body.

12 Claims, 10 Drawing Sheets

(58) Field of Classification Search
CPC ..... B65D 51/2835; B65D 2251/0056; B65D 2251/0093; B65D 2401/15; B65D 2251/0015
See application file for complete search history.

(56) References Cited

U.S. PATENT DOCUMENTS

| | | | | |
|---|---|---|---|---|
| 2004/0104245 | A1* | 6/2004 | Dubach | B65D 5/748 222/83 |
| 2004/0149786 | A1 | 8/2004 | Dubach | |
| 2004/0200837 | A1* | 10/2004 | von Spreckelsen | B65D 41/04 215/354 |
| 2012/0273996 | A1 | 11/2012 | Martini et al. | |
| 2013/0256336 | A1 | 10/2013 | Himmelsbach et al. | |
| 2014/0137717 | A1 | 5/2014 | Barron | |
| 2016/0200491 | A1* | 7/2016 | Dubach | B65D 51/222 222/83 |
| 2016/0229582 | A1 | 8/2016 | Dill et al. | |
| 2017/0197764 | A1 | 7/2017 | Hein et al. | |
| 2017/0225851 | A1 | 8/2017 | Wada et al. | |
| 2018/0079550 | A1 | 3/2018 | Dahl et al. | |
| 2019/0144158 | A1 | 5/2019 | Hauser et al. | |

FOREIGN PATENT DOCUMENTS

| | | | |
|---|---|---|---|
| JP | 2008162668 | A | 7/2008 |
| JP | 2012158361 | A | 8/2012 |
| JP | 201461943 | A | 4/2014 |
| JP | 2015193423 | A | 11/2015 |
| JP | 201650043 | A | 4/2016 |
| JP | 2020172301 | A | 10/2020 |
| WO | 03086890 | A1 | 10/2003 |
| WO | 2011144569 | A2 | 11/2011 |
| WO | 2012048935 | A1 | 4/2012 |
| WO | 2015058912 | A1 | 4/2015 |

OTHER PUBLICATIONS

"Polyolefins", Plastics Europe, pp. 9-11 of attached EPO Third-Party Observation dated Dec. 1, 2023, (https://plasticseurope.org/plastics-explained /a-large-family/polyolefins/).
Observations by Third Parties (submitted against EP21187218.9 published as EP4056489A1, dated Dec. 1, 2023, attached).

* cited by examiner

POURING ELEMENT AND COMPOSITE PACKAGE WITH IMPROVED OPENING BEHAVIOUR

CROSS-REFERENCE TO RELATED APPLICATIONS

This application is the United States national phase of International Application No. PCT/EP2021/086007 filed Dec. 15, 2021, and claims priority to European Patent Application Nos. 21020137.2 filed Mar. 10, 2021 and 21187218.9 filed Jul. 22, 2021, the disclosures of which are hereby incorporated by reference in their entireties.

BACKGROUND OF THE INVENTION

Field of the Invention

The invention relates to a pouring element for a composite package, comprising:

- a monolithic main body with a flange, a hollow cylindrical spout which defines a central axis, and a closure part formed in the spout, which runs substantially orthogonal to the central axis, with a weakening zone,
- a hollow cylindrical cutting element movably guided in the spout with at least one cutting tooth for severing the weakening zone to open the spout and composite package,
- a reclosable screw cap which is used to drive the cutting element when the composite package is opened for the first time.

Description of Related Art

Such pouring elements are integrated as part of the gable of the composite package for simplified handling during pouring and the possibility of reclosing composite packages. This type of pouring element is, for example, shown in the EP-A-2 627 569 from the applicant. The hollow cylindrical cutting element opens the main body and therefore the previously gas-tight package for the first time and thus forms a dispensing opening, wherein the screw cap allows the now open composite package to be reclosed. The cutting element, which is movably guided in the spout, is provided with force transmission elements and is thereby driven by corresponding force transmission elements on the cap. During the first opening process, the cutting element approaches the closure part and after the first contact of the two elements, the cutting tooth of the cutting element separates the closure part approximately in the region of the weakening zone. The movement path that the cutting element travels corresponds to the normally ring-shaped weakening zone.

The opening process can be divided into the following sections, for example. The approach of the cutting element mentioned above can also be omitted if the two elements already touch in the assembled state. The cutting element then moves through the closure part and separates it with the cutting tooth along a cutting line. This separation process is a combination of separation, plastic deformation and material displacement, wherein a uniform and controlled application of the forces is advantageous. As soon as a large part of the circumference has been separated, the cutting element starts to fold the closure part to the side and thus release the spout for the content. Folding away is carried out with the aid of the remaining piece of the weakening zone, which has not been separated, as a pivot axis, wherein first the cutting tooth and then the outer side of the cutting element exert force on the closure part during the course of folding away and thus press it to the side. After the pouring element has been completely opened, the closure part is approximately parallel to the central axis Z along the outer wall of the screwed-in cutting element.

Pouring elements with such a closure part are mainly, but not exclusively, used in aseptic packages. In this case, previously sterilised foodstuffs are packaged under aseptic conditions in similarly sterilised packaging materials in order then to obtain so-called aseptic packages. Apart from the question of aseptics, there are various types of composite packages into which a pouring element according to the invention can be integrated.

In a first manner, the pouring element is an integral part of the composite package, which is introduced during the manufacturing process of the same. For this purpose, cutouts of composite material, which are initially shaped into package sleeves by sealing the longitudinal seam, are usually firstly connected to the pouring element in a so-called "form fill and seal" packaging machine (FFS). These semi-shaped products, which are open on one side, are then filled with the product and sealed thereafter. The first step can be provided in different ways: For example, the flange can be connected to one side of the package sleeve by a further plastic element, which is injection-moulded directly in the packaging machine. The flange can also be welded directly to the package sleeve or even adhered to it without using an additional plastic element. In this case, the flange can be designed either the same size as the opening of the package sleeve or smaller in order to save plastic. In the case of a smaller flange, the surfaces of the package sleeve must be folded together and then placed on and welded with the flange. Preferably, such a composite package then has polyhedral gable surfaces which are correspondingly connected to the polyhedral flange of the pouring element, wherein the polyhedral flange substantially corresponds to a pyramid stump.

In a second manner, an initially completely sealed composite package is manufactured, wherein a punched hole is present in the composite package, usually in the gable region, into which a pouring element is introduced. The pouring element is usually inserted by welding the flange to at least one layer of the composite material, but alternatively these parts can also be adhered. This second type of composite package is also characterised in particular in that the insertion of the pouring element can be independent of the manufacture of the composite package. The production of the hole and also the insertion of the pouring element can therefore take place before, during or after the manufacture of the composite package itself. Both steps are preferred before manufacture in order not to make the packaging machines themselves unnecessarily complicated. This arrangement of the production steps also represents the simplest possibility of inserting the pouring element into the punched hole from the inside. Such a composite package is normally manufactured in one of two types of packaging machines. In this first alternative, an endless web of sterilised composite material is shaped into a tube and sealed, after which it is filled with the similarly sterilised product and sealed and cut at equal distances transversely thereto. The resulting "package pads" are then formed along the pre-folded edges into parallelepipedic packages. The sealing seam formed during transverse sealing in the gable region is usually referred to as a gable seam. The second alternative uses blanks of composite material, which are first shaped into package sleeves by sealing the longitudinal seam and then shaped on mandrels into package bodies open on one side, then sterilised, filled and lastly sealed and finally shaped. In this case, the gable region can be designed differently, such as for example as a parallel surface to the base surface (flat gable package), as a surface formed at least partially at an angle to the base surface (slanted gable package) or also as a saddle roof with two opposing, slanted surfaces ('gable top' package).

The precise layer structure of the composite material can vary depending on requirements, but at least consists of a carrier layer of cardboard and cover layers of plastic. In addition, a barrier layer (for example, aluminium (Al), polyamide (PA) or ethylene vinyl alcohol copolymer (EVOH) may be necessary in order to ensure an increased barrier effect against gases for aseptic products and also light in the case of aluminium. For this reason, such composite packages are also referred to as cardboard/plastic composite packages. If the pouring element is integrated as part of the composite package, it should have a similarly strong barrier effect against gases and light as the composite material used. At the same time, cheap materials should of course be used that are easy to recycle together. This also applies in particular to the materials of the pouring elements used.

In the prior art mentioned above, this problem of the necessary gas barrier was solved by selecting a favourable base material for the main body, namely LDPE, which was then supplemented by a barrier foil adjoining the main body in order to achieve very low oxygen transmission rates. Although this allowed favourable manufacture of the main body itself, but an expensive barrier foil and another error-prone production step were then necessary. In addition to the always important issue of cost, this also created potential problems because the edge region of the foil formed an unevenness, which could prove to be problematic in the aseptic process, as non-sterile pockets could form between the main body and barrier foil.

Based on this, the object underlying the present invention is to design and further develop the pouring element mentioned at the outset and previously described in more detail such that the described disadvantages are overcome.

SUMMARY OF THE INVENTION

This object is achieved in a pouring element with the features as described herein in that the main body consists of at least 92% by weight of HDPE and according to ASTM D3985 has an oxygen transmission rate between 12 and 23 ml $O_2/(m^2*day)$, measured through a measuring surface which is orthogonal to the central axis and runs through the flange of the main body. In principle, a lower oxygen transmission rate is desirable, as many foodstuffs packaged in composite packages are oxygen-sensitive and therefore enable a longer shelf life. Even smaller values of less than 12 ml $O_2/(m^2*day)$ would be advantageous, but are only possible through non-inventive and very expensive barrier designs, such as for example a previously mentioned barrier foil, a main body manufactured in two parts by multi-component injection moulding, which has a barrier material injected as a second component or a so-called scavenger material, which actively binds oxygen to itself over a limited period of time.

The expensive and complex barrier foil is therefore omitted in order to obtain a monolithic main body without foil, which itself is made of more expensive HDPE, but is significantly cheaper as a whole. As the names suggest, the distinction between LDPE (low density polyethylene) and HDPE (high density polyethylene) is made on the basis of their density. Polyethylene with a density between 940 and 970 kg/$m^3$ are usually considered as HDPE. In addition to the higher density, the higher crystallinity and different crystalline morphology also provide a better oxygen barrier and thus a lower oxygen transmission rate through components of HDPE compared to LDPE. HDPE usually has a crystallinity of approximately 50% to 80%. In most cases, small quantities of so-called masterbatches are added to the base material in addition to the at least 92 percent by weight HDPE. For example, lubricants or anti-blocking agents could be added to facilitate the release of the part from the injection-moulding tool or a light stabiliser which, as in one of the described embodiments, absorbs a certain wavelength range of the incoming radiation. Other commonly used masterbatches are, for example, nucleating agents, colour masterbatches or agents for increasing impact strength. Very often, the corresponding materials are already sold premixed for a certain shaping process.

In addition to material selection, the design of the weakening zone of the main body also enables the oxygen barrier to be improved. In particular, the axial height of the weakening zone and also the surface over which it extends is a clear influence, since the oxygen transmission takes place primarily through this region. In particular, if the main body is manufactured by injection moulding, the molten material must be pressed through the weakening zone during injection moulding in order to fill the entire forming tool. In order that the main body can be completely filled, the weakening zone, measured parallel to the central axis, should have at least a height of 0.1 mm, for example 0.13 mm. The combination of dimensions and internal structure of this weakening zone thus represents a further influence which influences the oxygen transmission rate through the entire main body, wherein the desired range of the oxygen transmission rate can be achieved by different embodiments. The measuring surface through which the oxygen transmission rate is measured should cover the entire main body if possible, but in any case the entire weakening zone (or its projection along the central axis onto the measuring surface) must lie within it. In ASTM D3985, oxygen transmission is measured primarily on foils held in the measuring device by a sealing material, wherein the sealing material also simultaneously defines the measuring surface. In the same way, a more complicated component, such as a main body specified here, can also be measured in such a measuring device in accordance with the standard. Normally, a two-component epoxy resin adhesive is used for sealing, for example "Devcon 5 Minute Epoxy", wherein the main body is for example attached to a sample holder adapted to the main body or to any flange of the measuring device which is suitable in size.

As described above, there are various non-inventive embodiments of a main element. For example, the one known from the prior art with a barrier foil attached thereto which, depending on the choice of foil, usually has oxygen transmission values between 2.5 and 10 ml $O_2/(m^2*day)$. The actual main element without a sealed foil is in the range of 40 to 50 ml $O_2/(m^2*day)$ and if an LLDPE, a linear LDPE, is used instead, the values even increase to 60 ml $O_2/(m^2*day)$.

A further design of the invention provides that the main body has an oxygen transmission rate of less than 20, preferably of less than 18, ml $O_2/(m^2*day)$, measured through a measuring surface which is orthogonal to the central axis and runs through the flange of the main body.

A further teaching of the invention provides that the weakening zone has less than 50% of the height of the remaining closure part measured parallel to the central axis.

This guarantees a clean separation of the weakening zone, combined with a stable closure part, which can also be folded completely to the side at the end of the opening process. At the same time, this guarantees that the majority of the oxygen transmission takes place through the weakening zone because the remaining closure part is designed to be significantly thicker. At the weakening zone, the lower wall thickness and higher pressure during manufacture in the tool influence the crystallinity. A faster cooling in the thinner region of the main element, for example, results in a higher and more uniform crystallinity. Preferably, the weakening zone even has less than 25% of the height of the remaining closure part.

In a further expedient embodiment, the weakening zone is designed in a ring shape and connects directly to the spout. On the one hand, this enables simplified production of the main body because the transition region between the spout and closure part can be formed more attractively. On the other hand, the forces are better transmitted during the separation process and absorbed by the spout.

In a further advantageous embodiment, the entire pouring element allows a light transmission of less than 1% in a wavelength range of 350 to 550 nm before the first opening. In addition to a high oxygen barrier, the composite package itself also has a barrier against light transmission. These barrier effects can come from different layers of the composite structure, such as for example a barrier layer of aluminium or partly also through the carrier layer. Since the composite material is not continuously formed in the region of the pouring element, the usual barrier effect cannot be guaranteed and therefore it is easiest and most cost-effective to supplement the pouring element with a masterbatch in such manner that it has a comparable barrier effect. Such a light barrier is particularly useful for light-sensitive products, such as for example milk. Damage to such products occurs above all in the stated wavelength range of 350 to 550 nm, which is why light should be absorbed particularly there. If no such masterbatch is introduced into the material for specific light absorption, the main body can also consist of at least 96 percent by weight of HDPE, since the light absorption masterbatch is usually added in quantities of 4 to 6% by weight. Any spectrophotometer can be used for measurement, such as for example a Specord 250 Plus from Analytik Jena or a Perkin-Elmer LAMBDA 850+, following the manufacturer's instructions.

In a further configuration of the invention, the cutting element and the screw cap also consist of polyolefins. As described above, the main body consists monolithically of HDPE, which is also known to be a polyolefin. In particular in the case of the cutting element, costs can in turn be reduced by this choice, compared to known cutting element materials such as polystyrene, which were previously used for pouring elements according to the invention with closure parts. Materials such as polystyrene tend to cause problems if longer dwell times occur during the production process—for example in the event of malfunctions. This very quickly leads to thermal degradation of the material, which makes it undesirably glassy. By choosing a polyolefin, such problems can be avoided. Despite these advantages, the known materials are actually better suited as cutting elements for pouring elements with closure parts with regard to the opening behaviour. Unexpectedly, it has been shown that cutting elements of polyolefins are sufficient for separating a main body according to the invention without barrier foil. In addition, this continuous material selection facilitates the recycling of the entire pouring element.

A further design of the invention provides that the entire pouring element consists of renewable raw materials. Typically, polyolefins are produced from fossil raw materials such as ethane, liquefied petroleum gas or petroleum. More recently, there has been an increased search for alternatives to obtain more sustainable products. Bioethanol has proven to be a viable path instead of the well-known fossil raw materials and has been produced, for example, from starch-containing, sugar-containing or cellulose-containing raw materials. Raw materials that do not require intensive agricultural management and also grow on inferior soil are preferred here. A polyolefin can then be produced from this bioethanol in the usual processes. In the present case, all components of the pouring element are manufactured from polyolefins and can therefore be manufactured with relatively little effort even from the same renewable raw materials.

In a further configuration of the invention, the cutting element consists of polypropylene. Of course, polypropylene is also a polyolefin and the aforementioned advantages generally also apply in this embodiment. Polypropylene is suitable as an inexpensive alternative to the conventionally used materials for the known pouring elements with closure parts.

A further advantageous embodiment relates to a polypropylene which has a flexural modulus of at least 1900 MPa. Particularly in the case of pouring elements with a main body of a stronger material such as HDPE, it is advantageous to use a rigid material with a correspondingly high flexural modulus for the cutting element. This guarantees that the cutting element has a stable effect at the desired position—in the weakening zone—and that the closure part also separates cleanly there without a tooth bending to the side, for example. In general, such a material also leads to improved cutting behaviour when scoring and cutting through the closure part or the weakening zone.

In a further advantageous embodiment, the cutting tooth extends at the end facing the weakening zone in the circumferential direction in a plane orthogonal to the central axis. The flattened end of the cutting tooth ensures that the cutting tooth separates the weakening zone more stably and is guided along the intermediate region. If the part of the projection on the intermediate region is so large that this end extending in a circumferential direction in a plane orthogonal to the central axis is arranged above the intermediate region, it also ensures that this cutting edge of the cutting tooth is cleanly directed outwards from the intermediate region until it reaches a region which is thin enough to be separated, such as for example the weakening zone itself.

A further design of the invention is that the cutting element is designed to be radially thickened inwards in the region of the cutting tooth. Reinforcement in the alignment of the cutting tooth ensures that the forces that occur during the various phases of the opening process are absorbed without any problems. This is particularly useful because the cutting tooth is a protruding part of the cutting element and therefore tends to break off. Adjustments to the cutting element which relate to the cutting process, such as for example set out in the previous embodiments, are usually located in the region of the cutting tooth. However, it is usually sufficient to restrict such changes locally in order to save as much material as possible in the remaining cutting element. In this sense, any reinforcement of the cutting element can be regarded as thickening, which is designed to protrude inwards on the hollow cylinder and for example has a maximum of 95% of the inner radius of the remaining hollow cylinder.

In a further expedient embodiment, the cutting element has two cutting teeth. In principle, a cutting element will pass through the phase of separation more quickly and transition to folding away, the more cutting teeth are formed on it, provided that these are distributed reasonably regularly over the circumference. On the other hand, the force increases when opening with each additional cutting tooth, which simultaneously penetrates into the closure part with cutting teeth of the same length. With this selection, a good compromise is reached between the necessary rotation of the screw cap and the force required thereto.

In a further configuration of the invention, an injection-moulding point is located on the closure part on the central axis. In most cases, the individual components of the pouring element are manufactured by an injection-moulding process. Here, a tool with a negative shape of the part to be produced is filled with liquid plastic, which then solidifies before this tool opens and thus ejects the finished part. Normally, the liquid plastic is filled via a single nozzle, whereby the solid plastic part separates from the remaining plastic, which is still in the nozzle, during ejection.

Of course, this separation can also take place before ejection via the nozzle itself. In all cases, a visible and usually protruding unevenness of the surface occurs on the plastic part, which is commonly referred to as the injection point. Filling with liquid plastic is slower the more material has to be pressed through narrow points, such as for example the weakening zone. Surprisingly, it has been shown that the advantages of a central injection point and therefore an even filling of the entire main body prevail, although a large part of the liquid plastic then has to move through the weakening zone.

In an expedient embodiment of the invention, a composite package for liquid foodstuffs is provided such that a pouring element according to the invention is integrated into the gable region of the composite package. There are various ways of manufacturing such a composite package, as has already been explained. In this case, the pouring element often serves primarily to close the opening in the gable region and has a rather secondary effect with regard to the dimensional stability of the composite package.

Another advantageous embodiment of the invention relates to a composite package which is provided such that a pouring element according to the invention is integrated into the gable region of the composite package, wherein the gable region has polyhedral gable surfaces which are correspondingly connected to a polyhedral flange of the pouring element. As already described, this combination allows a bottle-like composite package to be formed without the need for further components.

ASTM D792-20 is used to determine the density of plastics. ISO178 is a suitable method for the flexural modulus.

BRIEF DESCRIPTION OF THE DRAWINGS

The invention will be explained in more detail below on the basis of a drawing which simply represents two preferred exemplary embodiments. The drawing shows FIG. 1 a pouring element according to the invention in perspective view, FIG. 2 the pouring element according to the invention in plan view, FIG. 3 the pouring element according to the invention from FIG. 2 in the vertical section along the line III-III, FIG. 4 a detailed view of the vertical section from FIG. 3, FIG. 5 a detailed view of the vertical section from FIG. 3 during the opening process, FIG. 6 a screw cap in plan view, FIG. 7 the screw cap from FIG. 6 in the vertical section along the line VII-VII, FIG. 8 the screw cap from FIG. 6 in perspective view from below, FIG. 9 a cutting element according to FIG. 3 in perspective view from above, FIG. 10 the cutting element in perspective view from below, FIG. 11 a composite package according to the invention with integrated pouring element after the first opening and reclosing of the screw cap in a sectioned perspective view, FIG. 12 a pouring element according to the invention of a second exemplary embodiment in perspective view, FIG. 13 the pouring element according to the invention from FIG. 12 in plan view, FIG. 14 the pouring element according to the invention from FIG. 13 in the vertical section along the line XIV-XIV, FIG. 15 the pouring element according to the invention from FIG. 13 in the vertical section along the line XV-XV, FIG. 16 a detailed view of the vertical section from FIG. 15, FIG. 17 a screw cap of the second exemplary embodiment in perspective view and FIG. 18 a cutting element of the second exemplary embodiment in perspective view.

DESCRIPTION OF THE INVENTION

Figure 1:
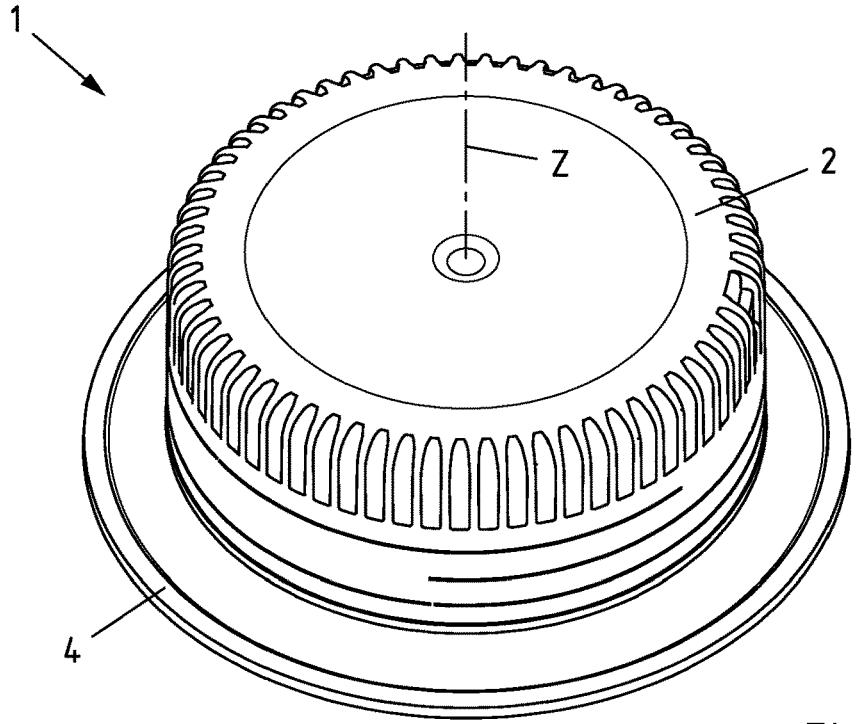

Two preferred embodiments of a pouring element 1 and 1' according to the invention are represented in the drawing in order to make clear the mode of operation when opening. FIG. 1 shows a first pouring element 1 in a closed state with a central axis Z without composite package P. A reclosable screw cap 2, which is used for the first opening and for reclosing the composite package P, is located on a main body 3, which is only clearly visible in FIG. 3 and from which in FIG. 1 only one circumferential flange 4 is visible, which is used for connection with and integration into the composite package P. In the plan view of FIG. 2, a section line III-III is also drawn in.

Figure 3:
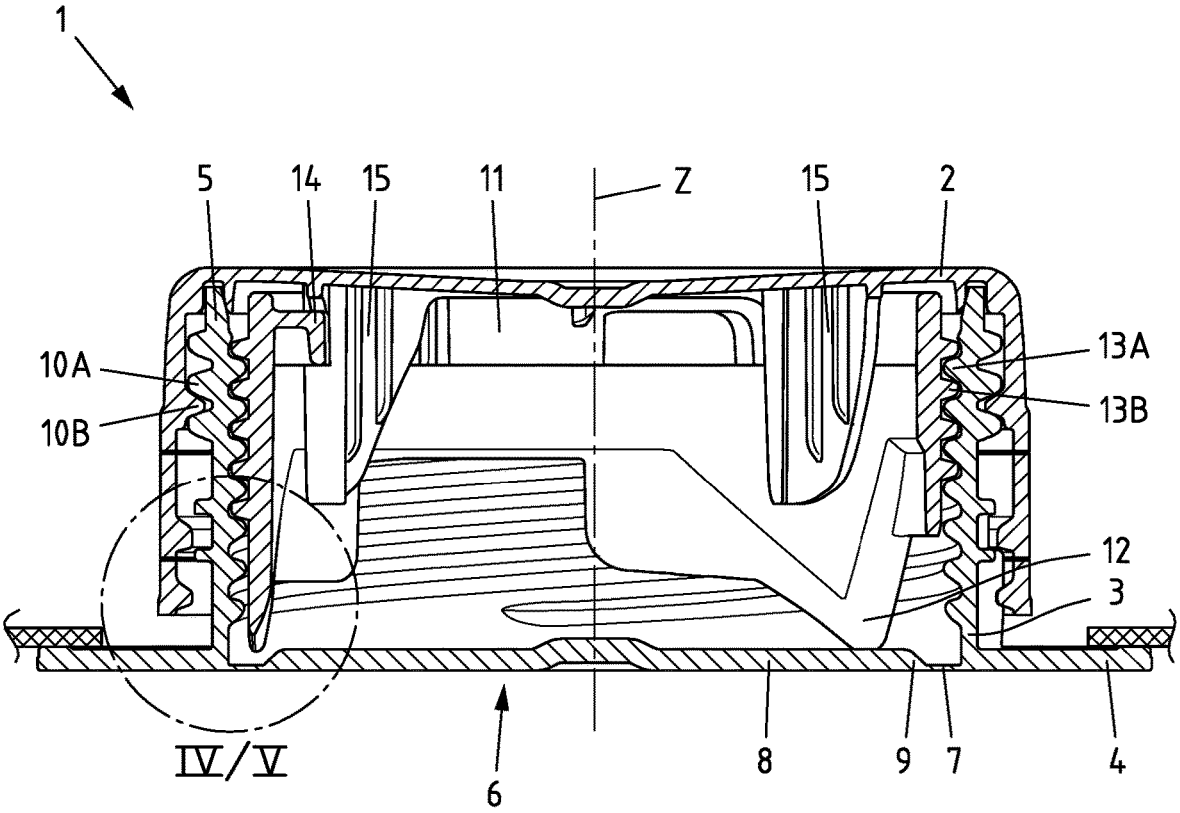

FIG. 3 shows the entire pouring element 1 in the vertical section along the section line III-III. The main body 3 also has a hollow cylindrical spout 5 and a closure part 6 formed in the spout 5. The closure part 6 comprises a ring-shaped weakening zone 7, which adjoins the spout 5, a central region 8, which closes the majority of the dispensing opening, and a conical ring-shaped intermediate region 9, which extends between weakening zone 7 and central region 8. The chamfering of the intermediate region 9 compensates for the thickness difference between the central region 8 and the weakening zone 7. In this sectional view, it is also discernible that both the circumferential flange 4 and the central region 8 have approximately six times the height of the weakening zone 7. This clearly shows how oxygen is most permeated through the weakening zone 7, wherein the sealing of the screw cap 2 to this interior of the pouring element 1 can never be designed to be completely gas-tight.

Between screw cap 2 and the outer side of the spout 5 there is a first thread pair 10A and 10B, which enables screw cap 2 to be screwed on and tightened. A hollow cylindrical cutting element 11 with two cutting teeth 12 is arranged inside the main body 3, which separates the closure part 6 when the pouring element 1 and thus the composite package P are opened for the first time. The central axis Z is defined by the concentrically arranged hollow cylindrical elements of the spout 5 and the cutting element 11, wherein the cutting element 11 rotates about the central axis Z and moves along it during the opening process. This movement is defined by a second thread pair 13A and 13B, which is located between the inner side of the spout 5 and the cutting element 11. In this movement, the cutting element 11 is driven on at least one force takeover element 14, which interacts with at least one corresponding force transmission element 15 of the screw cap 2.

Figure 4:
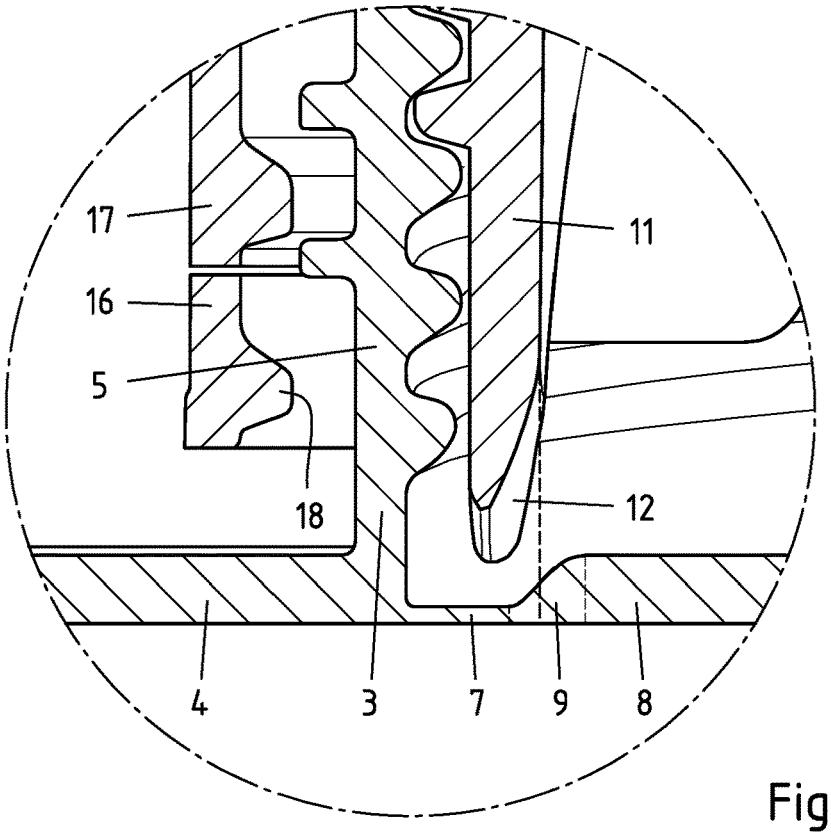
Figure 5:
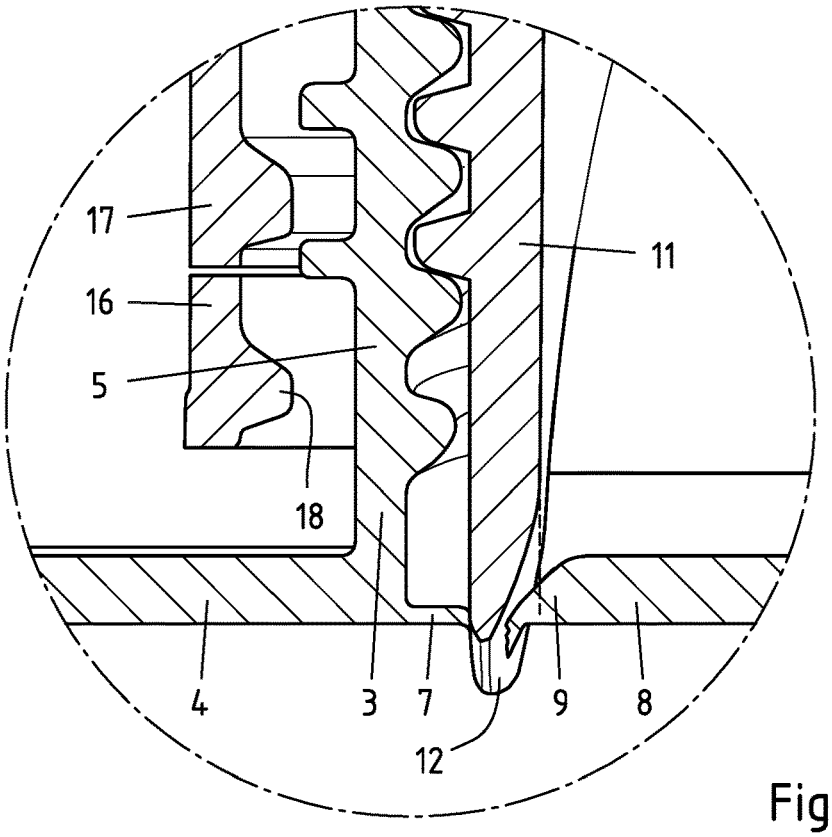

The detailed views in FIGS. 4 and 5 show how the cutting teeth 12 strike the weakening zone 7 and the intermediate region 9 and start to separate this region. FIGS. 3 and 4 show the original arrangement of the elements before the first opening and FIG. 5 the one during the opening process. It is particularly easy to see here how the cutting element 11 and therefore the cutting teeth 12 are arranged above the intermediate region 9, since the inner delimitation of the projection of the cutting tooth 12 is also shown with the projection line represented with a dashed line.

Figure 2:
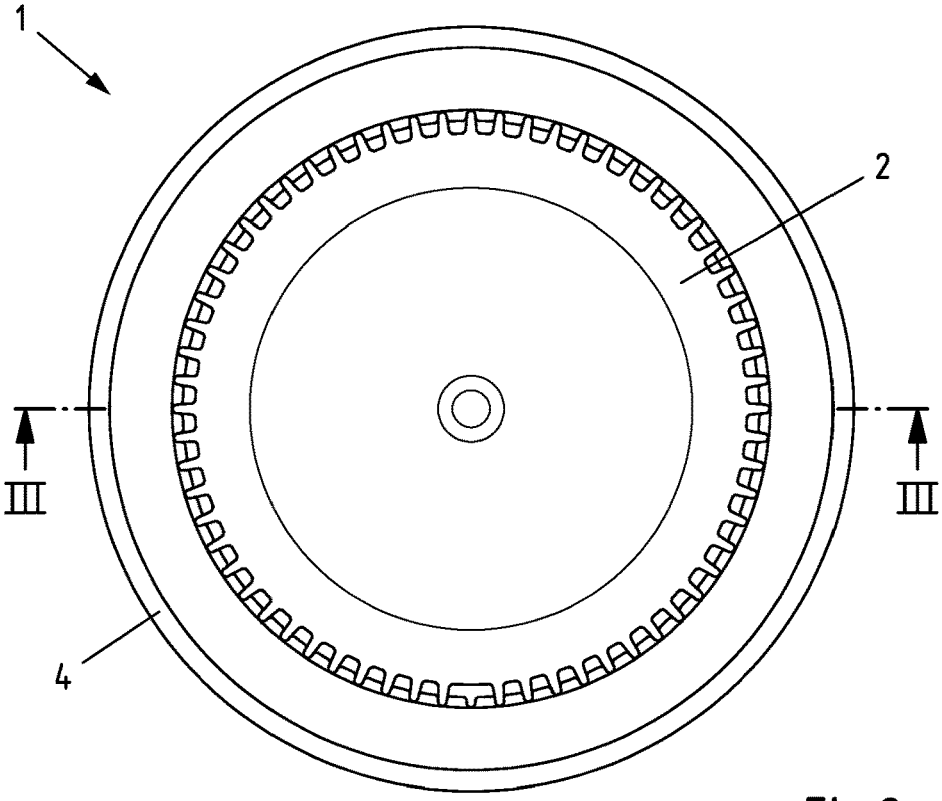
Figure 6:
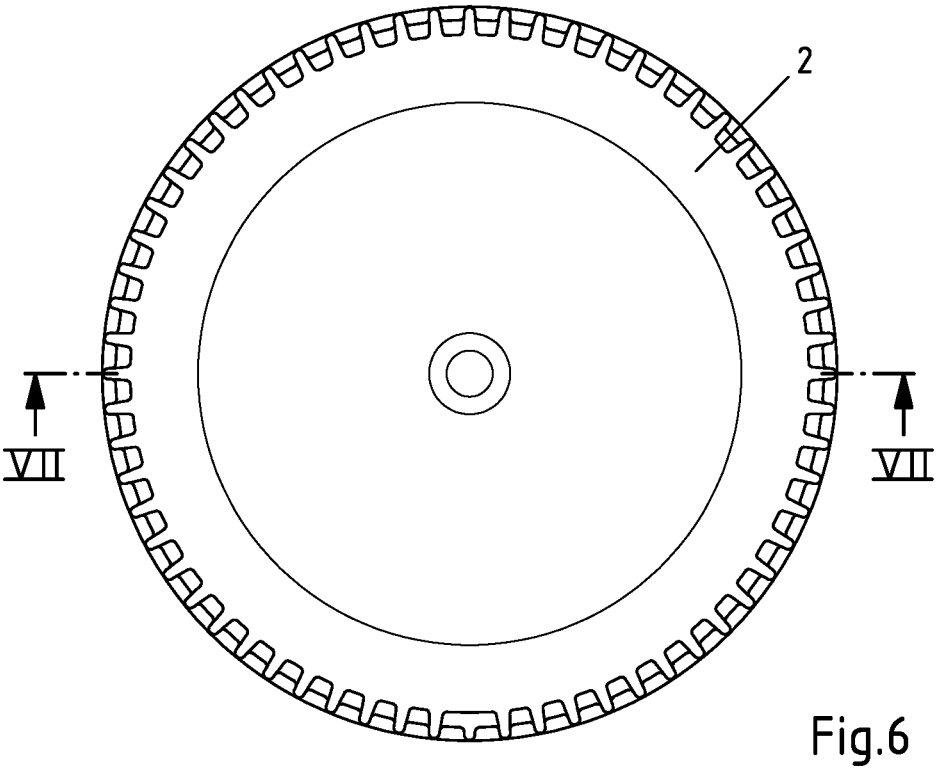
Figure 7:
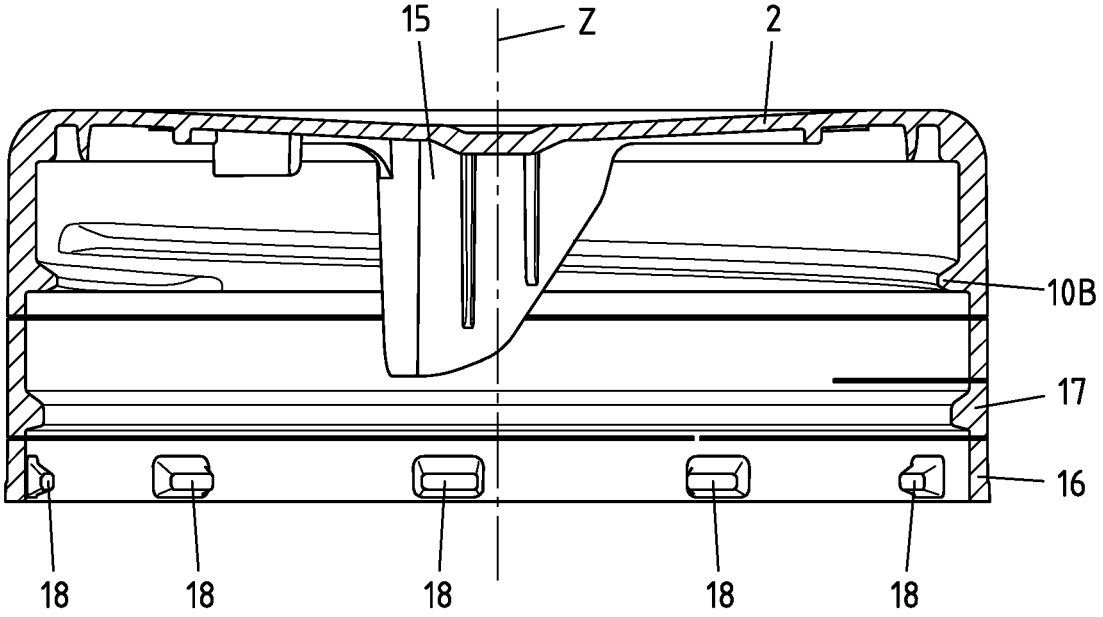
Figure 8:
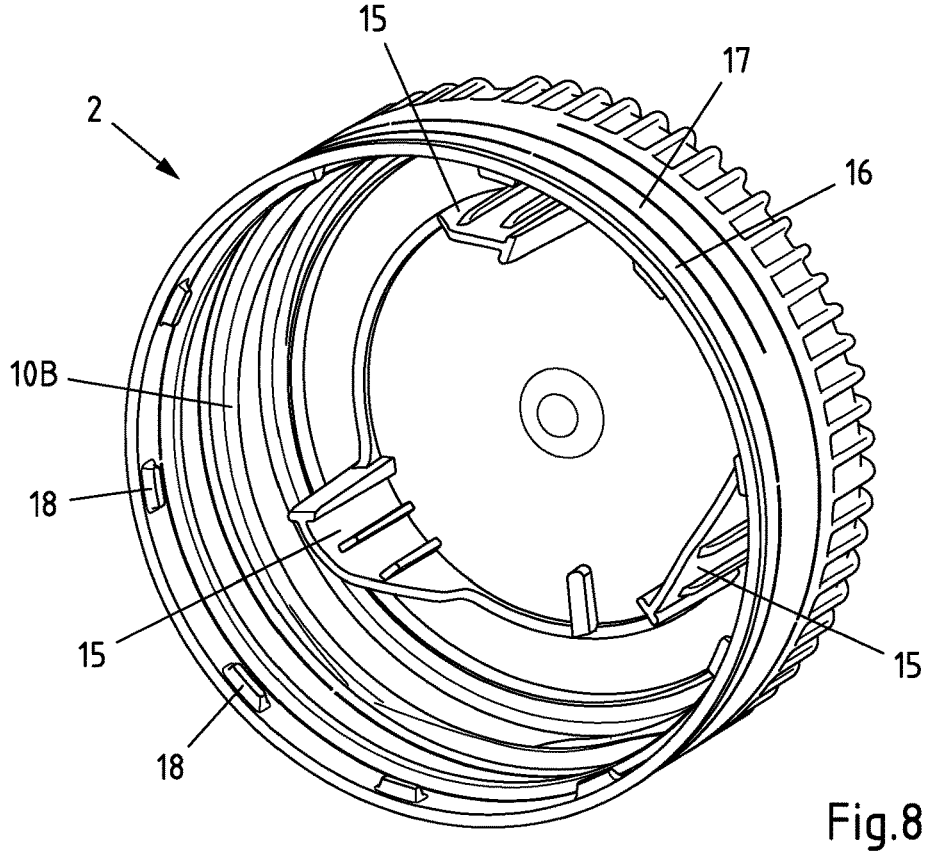

FIGS. 6 to 8 correspond approximately to the views in FIGS. 1 to 3, wherein only the screw cap 2 is shown here. In this case, half of the first thread pair 10A in FIG. 7 and the three force transmission elements 15 in FIG. 8 are particularly clearly visible. The screw cap 2 also has a strip 16 serving as a tamper-evident seal and an anchor ring 17. For this purpose, the strip 16 immediately detaches from the rest of the screw cap 2 when opened for the first time and remains visibly separated in its original position. Stop elements 18 on the strip 16, which hook onto corresponding elements of the main body 3, ensure that the strip 16 has already detached from the rest of the screw cap 2 before the cutting element 11 impairs the integrity of the closure part 6 during separation. The anchor ring 17 also detaches during the first opening process and then remains on the spout 5, wherein the anchor ring 17 and the rest of the screw cap 2 remain connected by retaining elements. These are designed such that the screw cap 2, after it has been unscrewed from the spout 5, can be folded to the side in order to enable pouring. The arrangement of the mentioned parts of the screw cap 2 and the corresponding elements of the spout 5 can also be seen in the detailed views of FIGS. 4 and 5.

Figure 9:
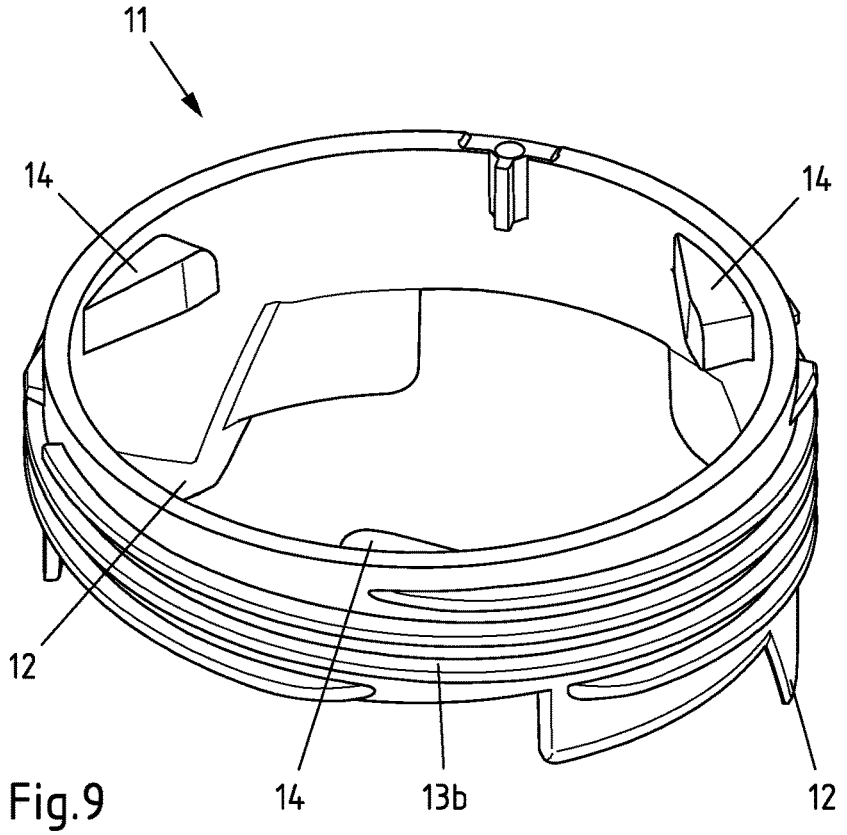
Figure 10:
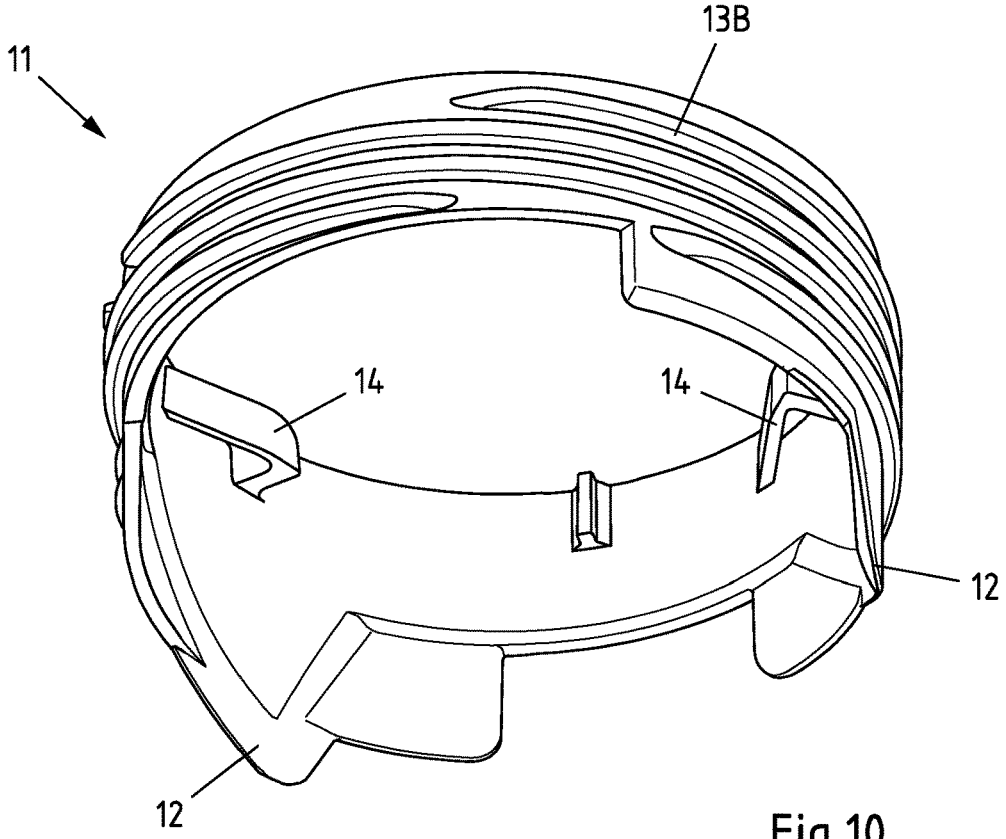

In FIGS. 9 and 10, a single cutting element 11 is also represented in two different perspective views. The two cutting teeth 12, which are formed at the lower end of the cutting element 11, are now clearly visible. The three force takeover elements 14 can also be seen on the inner wall and the thread of the second thread pair 13B on the outer wall.

Figure 11:
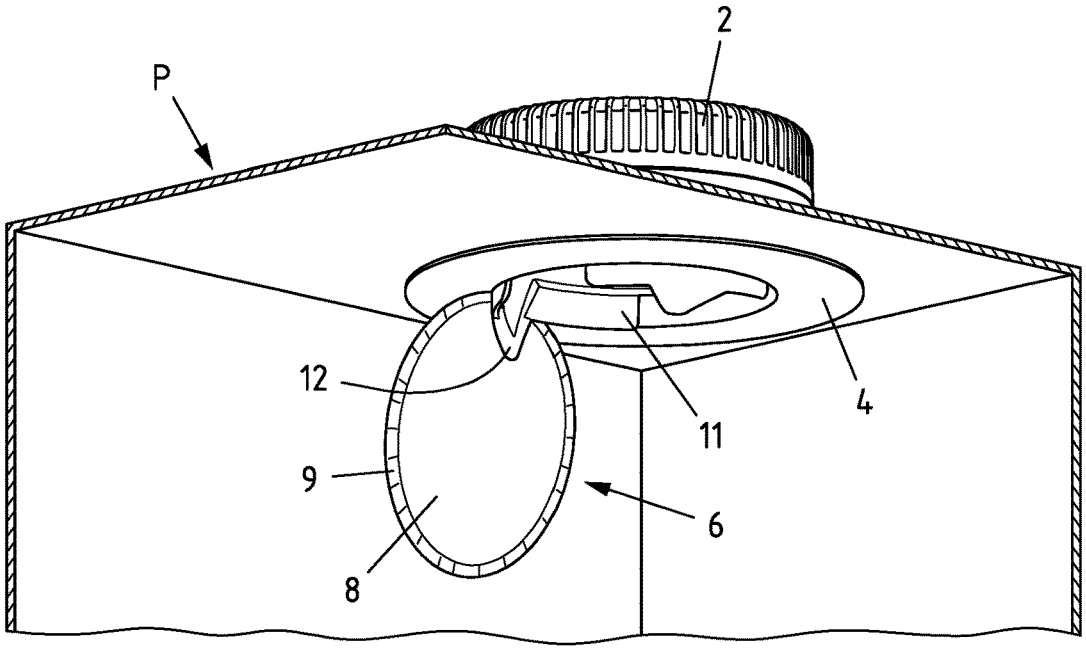
Figure 12:
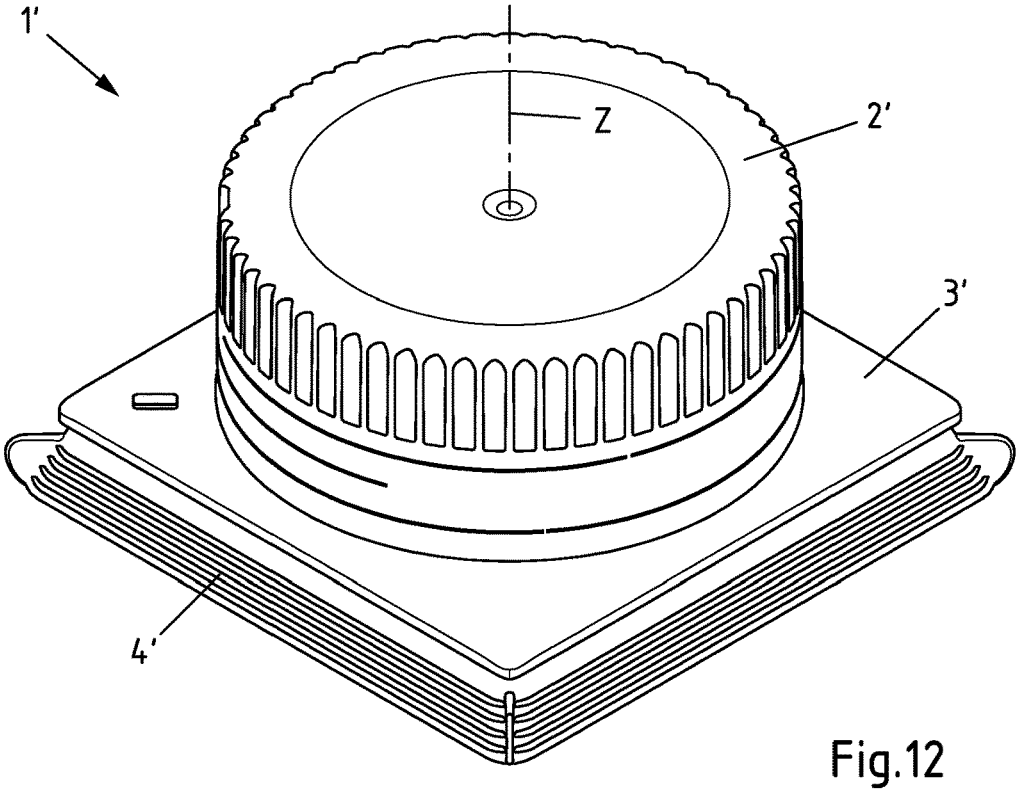
Figure 13:
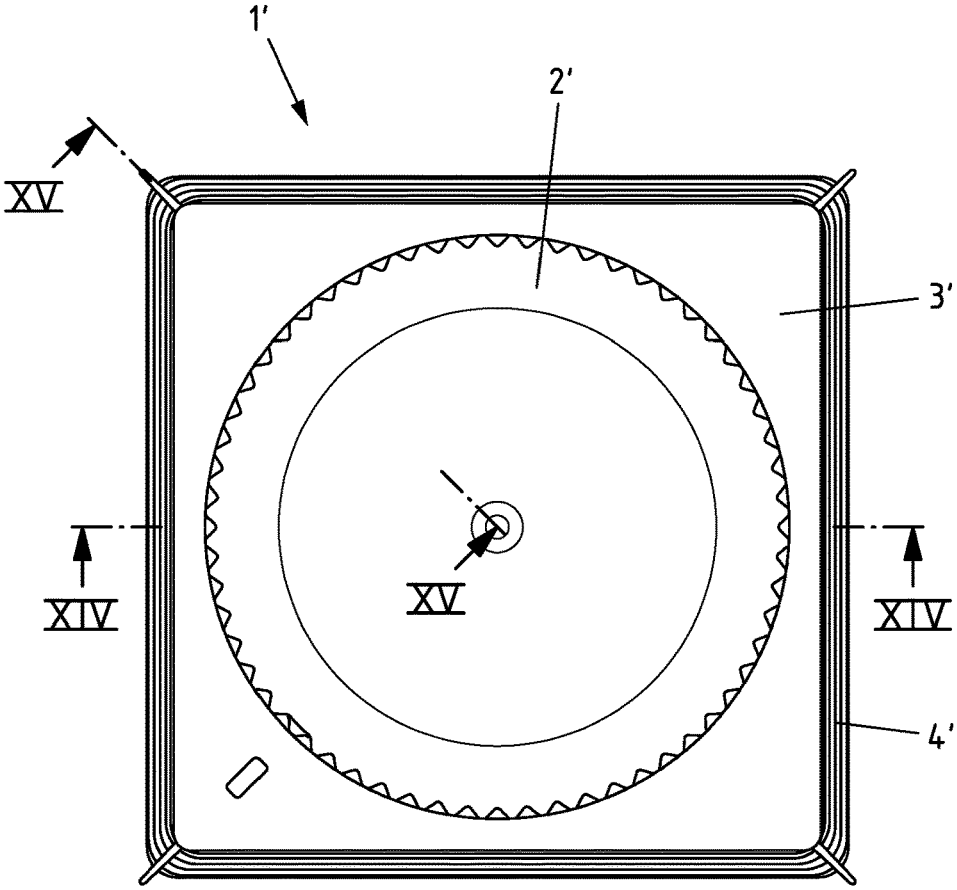
Figure 14:
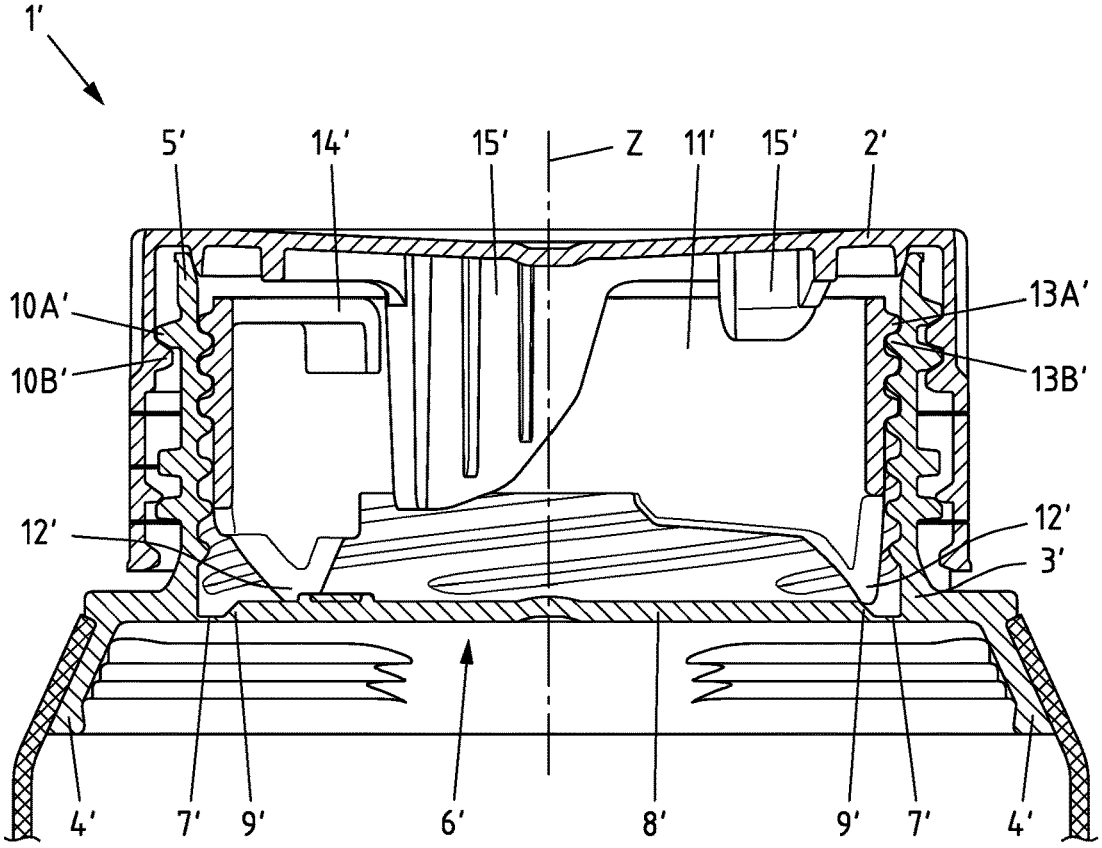

An open composite package P with reclosed screw cap 2 can be seen in the sectioned view of FIG. 11 from the inside, wherein a tab is particularly noticeable. This occurs because the closure part 6 loses its tension during the separation process before the cutting element 11 could cut a complete circle. The tab, which roughly corresponds to the central region 8 and the intermediate region 9, then only holds on a single segment of the weakening zone 7, is pressed to the side by the further movement of the cutting element 11 and thus releases the dispensing opening. This segment of the weakening zone 7 is sufficient to hold the tab in its "folded away" state when the composite package P is open in order to reliably prevent an unintentional tearing off of the tab and complete severing of the weakening zone 7. The cutting tooth 12 formed at the front in the direction of rotation is positioned at the end of the first opening such that it is at the height of the tab and thus holds it stable to the side.

FIGS. 12 to 18 of the drawing show a second preferred exemplary embodiment, wherein the differences are in particular pointed out. The remaining embodiments of the first exemplary embodiment also apply accordingly to the following part. The flange 4' of the main body 3' is designed here as a pyramid stump in a polyhedral shape. In particular, it should be noted that the contact surfaces with the composite material of the composite package P' no longer lie in a plane, but are provided by the four side surfaces of the pyramid stump, as is particularly discernible in FIGS. 12 to 14. Apart from the flange 4', the basic structure of the pouring element 1' is comparable with the first exemplary embodiment: It is also a three-part pouring element 1' with a main body 3', a screw cap 2' and a cutting element 11'. Between the screw cap 2' and the outer side of the spout 5' of the main body 3 is located the first thread pair 10A', 10B' and the second thread pair 13A', 13B' connects the inner side of the spout 5' to the cutting element 11' in order to arrange it in a movable manner. Comparable elements are also designed for transmitting force during the opening process from the screw cap 2' to the cutting element 11', wherein in FIGS. 17 and 18, it can be seen that screw cap 2' and cutting element 11' are connected to one another by respectively two force transmission elements 14' and force transmission elements 15'.

Figure 15:
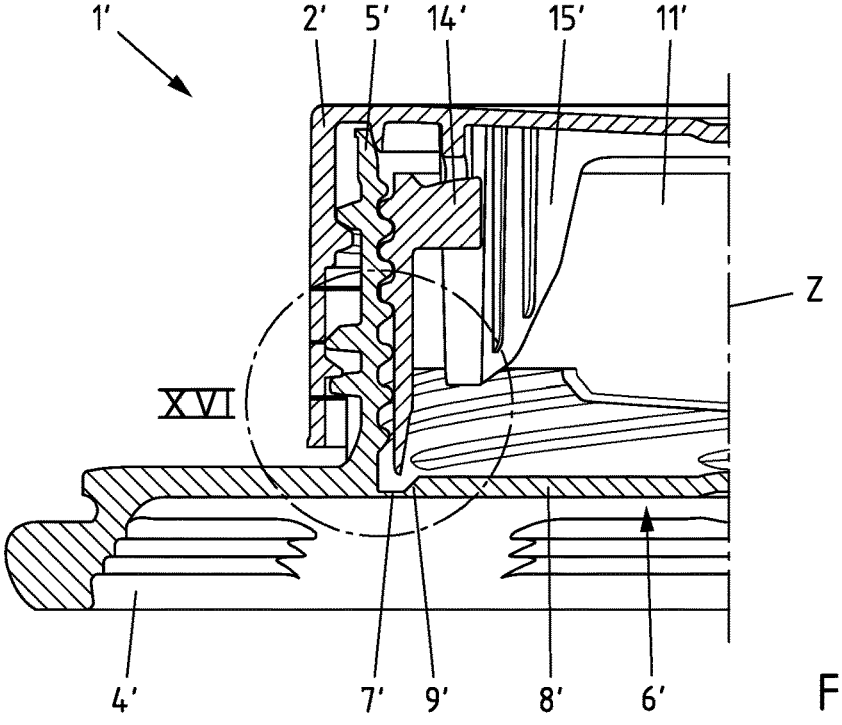
Figure 16:
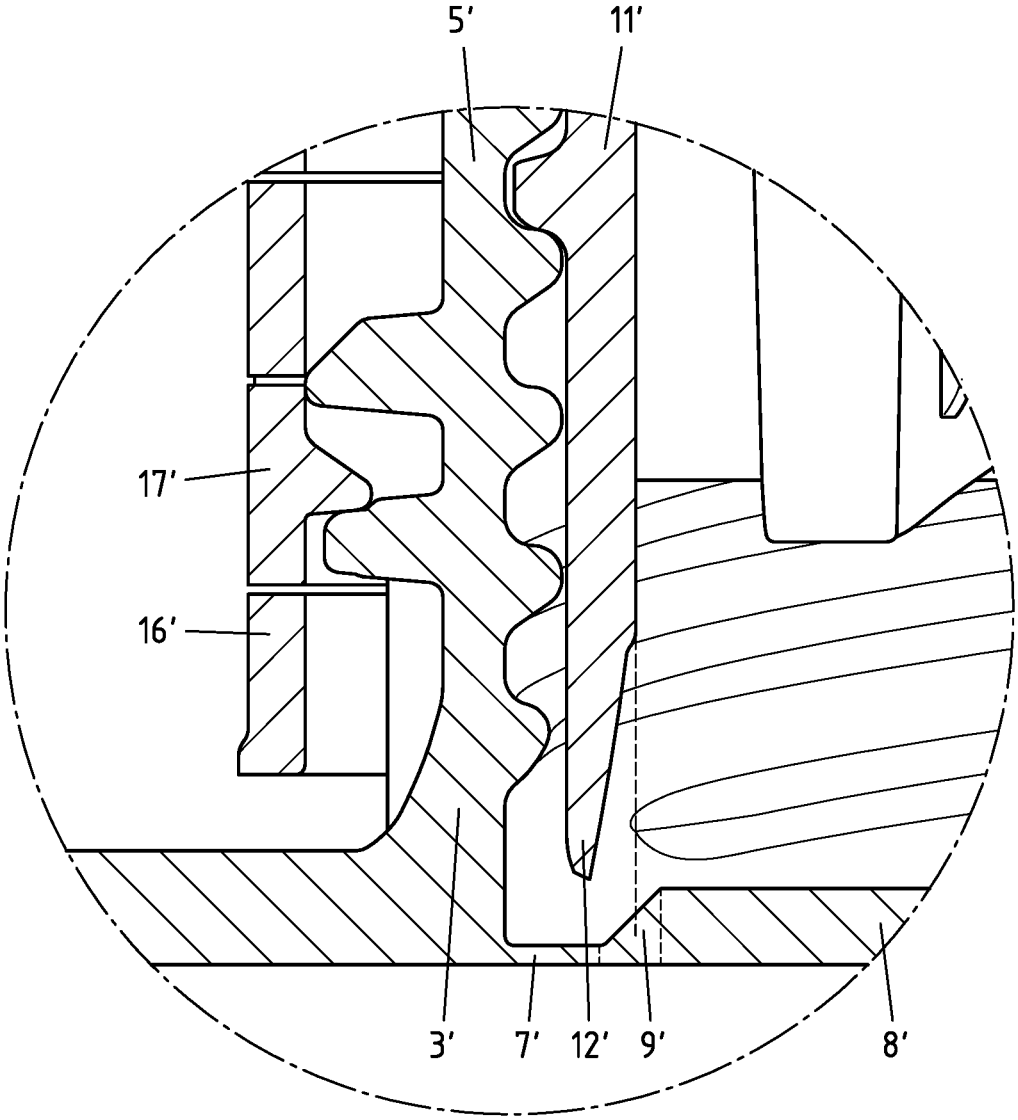
Figure 17:
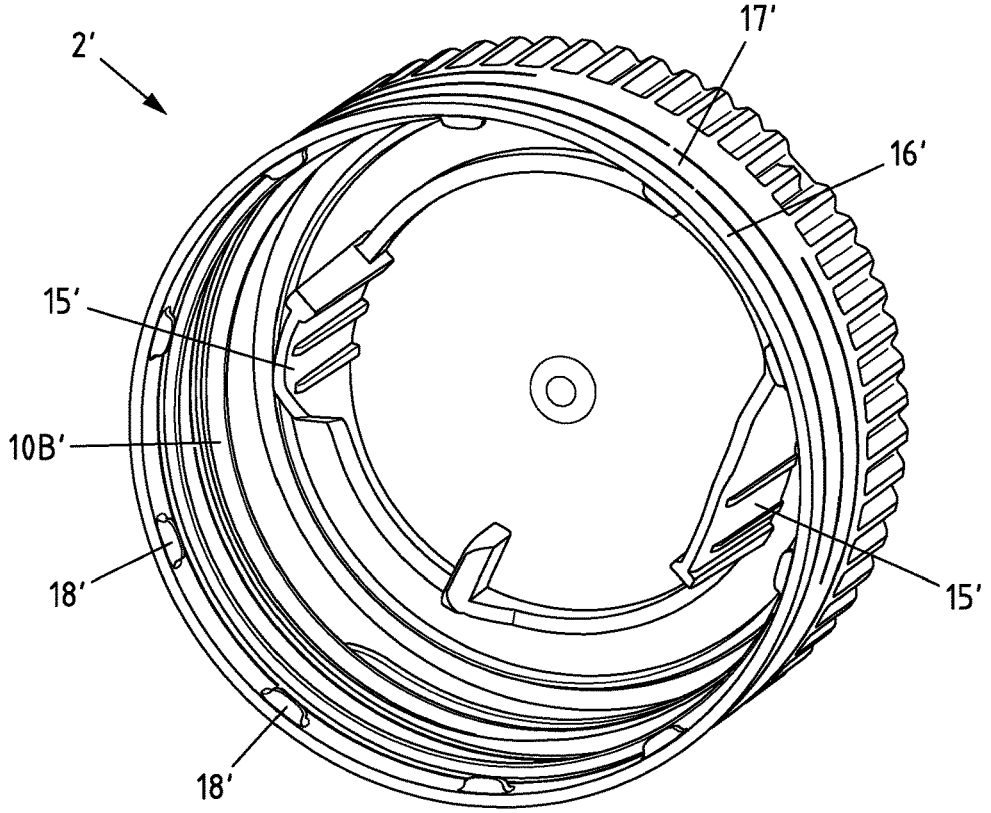
Figure 18:
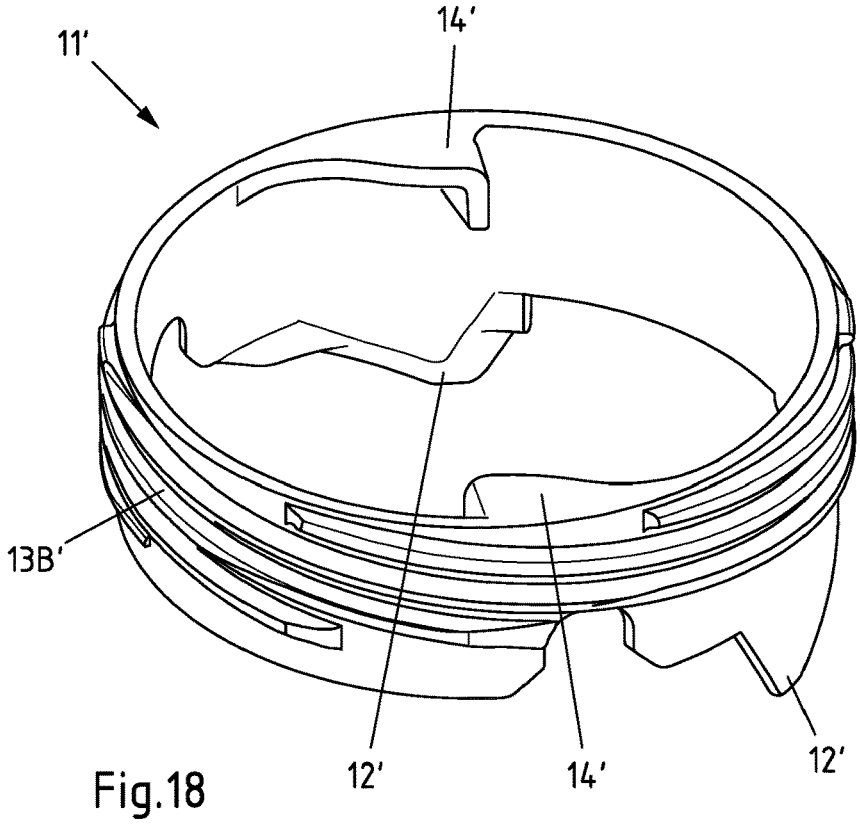

Finally, FIGS. 15 and 16 clearly show that a modification of the cutting element 11' can also be carried out in that the cutting tooth 12', in particular in the upper region, is designed reinforced in its thickness. Thus, the cutting element 11' is thickened radially inwards such that it protrudes over the intermediate region 9' in the assembled state and comes into contact therewith during the opening process.

The invention claimed is:

1. A pouring element for a composite package, comprising:

a monolithic main body with a flange, a hollow cylindrical spout, which defines a central axis, and a closure part formed in the spout, which runs substantially orthogonal to the central axis, with a weakening zone, a hollow cylindrical cutting element movably guided in the spout with at least one cutting tooth for severing the weakening zone to open the spout and composite package, a reclosable screw cap, which serves to drive the cutting element when the composite package is opened for the first time, wherein the main body consists of at least 92% by weight of HDPE and according to ASTM D3985 has an oxygen transmission rate between 12 and 23 ml $O_2$/($m^2$*day), measured through a measuring surface which is orthogonal to the central axis and runs through the flange of the main body, wherein the weakening zone has less than 50% of the height of the remaining closure part measured parallel to the central axis, wherein the cutting tooth extends at the end facing the weakening zone in a circumferential direction in a plane orthogonal to the central axis and that the cutting element is thickened radially inwards such that it protrudes over an intermediate region in an assembled state and comes into contact therewith during an opening process, and wherein the main body is molded as a single component and excludes a separately applied barrier foil.

2. The pouring element according to claim 1, wherein the main body has an oxygen transmission rate of less than 20, preferably of less than 18, ml $O_2$/($m^2$*day), measured through a measuring surface which is orthogonal to the central axis and runs through the flange of the main body.

3. The pouring element according to claim 1, wherein the weakening zone is designed in a ring shape and connects directly to the spout.

4. The pouring element according to claim 1, wherein the entire pouring element allows a light transmission of less than 1% in a wavelength range of 350 to 550 nm before the first opening.

5. The pouring element according to claim 1, wherein the cutting element and the screw cap also consist of polyolefins.

6. The pouring element according to claim 5, wherein the entire pouring element consists of renewable raw materials.

7. The pouring element according to claim 1, wherein the cutting element consists of polypropylene.

8. The pouring element according to claim 7, wherein the polypropylene has a flexural modulus of at least 1900 MPa.

9. The pouring element according to claim 1, wherein the cutting element is designed to be radially thickened inwards in the region of the cutting tooth.

10. The pouring element according to claim 1, wherein the cutting element has two cutting teeth.

11. A composite package for liquid foodstuffs wherein the pouring element according to claim 1 is integrated into a gable region of the composite package.

12. The composite package for liquid foodstuffs according to claim 11, wherein the gable region has polyhedral gable surfaces, which are correspondingly connected to a polyhedral flange of the pouring element.

* * * * *